United States Patent [19]

Wood

[11] 4,101,069

[45] Jul. 18, 1978

[54] ARTICLE CARRIER

[75] Inventor: Prentice J. Wood, Hapeville, Ga.

[73] Assignee: The Mead Corporation, Dayton, Ohio

[21] Appl. No.: 845,471

[22] Filed: Oct. 26, 1977

[51] Int. Cl.[2] ..... B65D 5/02

[52] U.S. Cl. ..... 229/40

[58] Field of Search ..... 229/40

[56] References Cited

U.S. PATENT DOCUMENTS

| | | | |
|---|---|---|---|
| 2,050,894 | 8/1936 | Paige | 229/8 |
| 3,278,075 | 10/1966 | Weiss | 229/40 X |
| 3,306,519 | 2/1967 | Wood | 229/40 |
| 3,670,950 | 6/1972 | Rossi | 229/40 |
| 3,797,729 | 3/1974 | Holmes | 229/40 |
| 3,904,036 | 9/1975 | Forrer | 229/40 X |
| 4,022,372 | 5/1977 | Graser | 229/40 |

*Primary Examiner*—Davis T. Moorhead

*Attorney, Agent, or Firm*—Walter M. Rodgers; Walter A. Rodgers

[57] ABSTRACT

An article carrier is formed from a unitary blank and includes top, bottom and side walls interconnected to form a tubular structure around a plurality of articles and includes a connecting panel foldably joined to an end edge of one of said side walls along a first arcuate fold line, an end panel foldably joined to the connecting panel remote from the side wall along a second arcuate fold line, and the first and second arcuate fold lines being configured in a concave relationship with respect to the connecting panel.

5 Claims, 3 Drawing Figures

ARTICLE CARRIER

Article carriers are known in which so-called "tavern door" type end panels are utilized to form a fully enclosed article carrier which is especially adapted for the packaging of light sensitive products such as beer and the like. One embodiment of this type carrier is disclosed and claimed in U.S. Pat. No. 3,306,519 granted Feb. 28, 1967 and which is owned by the assignee of this invention. Article carriers of this type utilize mechanical locking means to secure the end panels in the closed position. While this arrangement constitutes a satisfactory package, it requires complicated and expensive carrier forming machinery to lock the end panels together.

According to this invention an article carrier is provided which eliminates the need for complicated machinery and comprises a top wall, a pair of side walls secured respectively to the side edges of the top wall, a bottom wall secured to the edge of the side walls remote from the top wall, a connecting panel foldably joined to an end edge of one of the walls along a first arcuate fold line, and an end panel foldably joined to the connecting panel remote from the one wall along a second arcuate fold line, the first and second arcuate fold lines being configured in a concave relationship with respect to the connecting panel.

Figure 1:
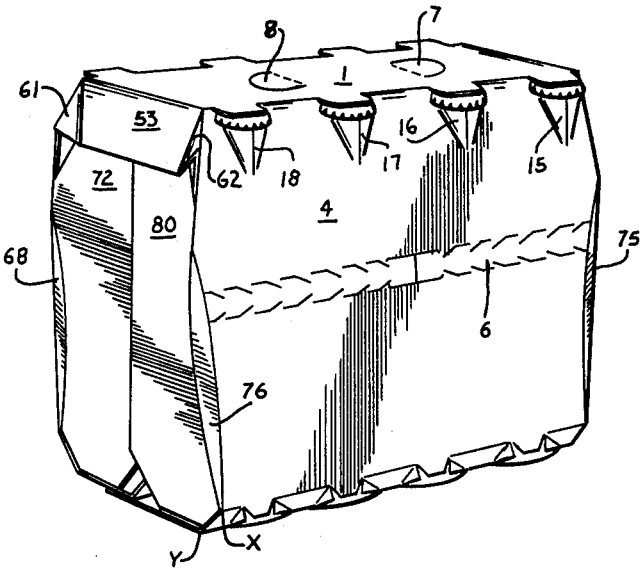
Figure 3:
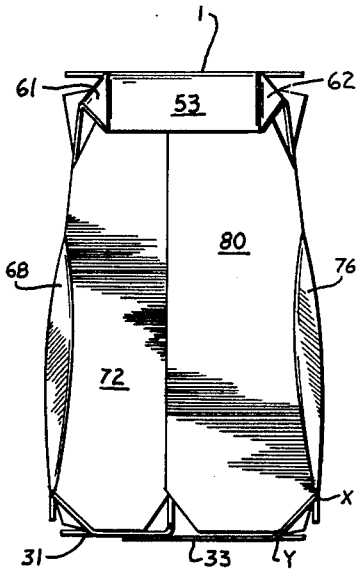
Figure 2:
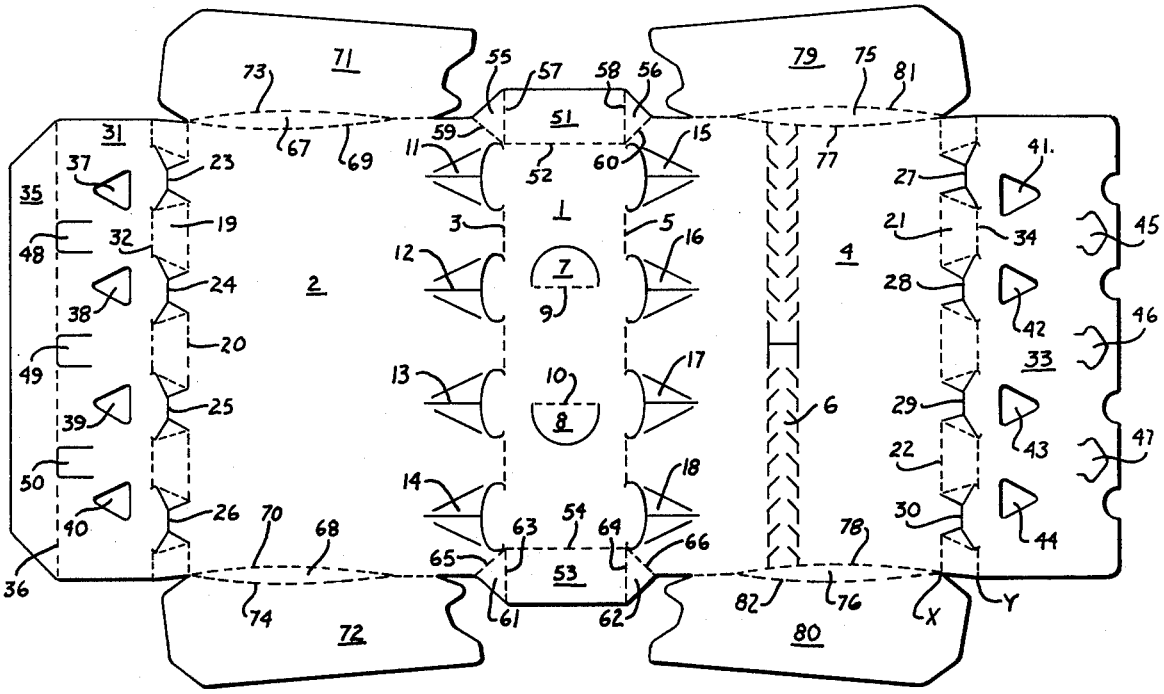

For a better understanding of the invention, reference may be had to the following detailed description taken in conjunction with the accompanying drawing in which FIG. 1 is an isometric view of a completed carrier formed according to this invention;

FIG. 2 is a plan view of a blank from which the carrier shown in FIG. 1 is formed; and in which FIG. 3 is an end view of a completed carrier.

In the drawings the numeral 1 designates a top wall of the carrier to a side edge of which side wall 2 is foldably joined along interrupted fold line 3. In like fashion, side wall 4 is foldably joined to top wall 1 along interrupted fold line 5. To allow for easy access to the carrier contents, a tear strip 6 is formed in side wall 4 in known manner.

Finger receiving apertures defined by tabs 7 and 8 are formed in top wall 1 and are foldably joined, respectively, to top wall 1 along fold lines 9 and 10. In addition neck receiving apertures 11, 12, 13 and 14 are formed in the upper portion of side wall 2. Likewise neck receiving apertures 15, 16, 17 and 18 are formed in the upper portion of side wall 4.

Along the lower edge of side wall 2, sloping panel 19 is foldably joined along interrupted fold line 20. Also sloping panel 21 is foldably joined to the lower edge of side wall 4 along interrupted fold line 22. As is well known, heel receiving apertures 23, 24, 25 and 26 are formed in sloping panel 19. In like fashion heel receiving apertures 27, 28, 29 and 30 are formed in sloping panel 21.

Bottom panel 31 is foldably joined to sloping panel 19 along interrupted fold line 32 and, similarly, bottom panel 33 is foldably joined to sloping panel 21 along interrupted fold line 34. In addition bottom panel 31 is provided with medial keel panel 35 which is foldably joined thereto along fold line 36.

In order to facilitate formation of the carrier, machine tightening apertures 37, 38, 39 and 40 are formed in bottom panel 31. Also machine tightening apertures 41, 42, 43 and 44 are formed in bottom panel 33. Locking apertures defined by retaining tabs 45, 46 and 47 are formed in bottom panel 33 and locking apertures 48, 49 and 50 are formed in bottom panel 31.

End flap 51 is foldably joined to an end edge of top wall 1 along fold line 52 and, likewise, end flap 53 is foldably joined to the opposite end edge of top wall 1 along fold line 54. End flap 51, at the ends thereof, is provided respectively with web panels 55 and 56 which are foldably joined thereto respectively along fold lines 57 and 58. Web panels 55 and 56 are foldably joined respectively to side walls 2 and 4 along fold lines 59 and 60. In like manner web panels 61 and 62 are foldably joined respectively to the ends of end flap 53 along fold lines 63 and 64. The opposite ends of web panels 61 and 62 are foldably joined respectively to side walls 2 and 4 along fold lines 65 and 66.

According to a feature of this invention, connecting panels 67 and 68 are foldably joined to the opposite ends of side wall 2 along arcuate fold lines 69 and 70 respectively. In addition end panels 71 and 72 are foldably joined to connecting panels 67 and 68 remote from side wall 2 along arcuate fold lines 73 and 74 respectively.

The end closure structure at the opposite end of the blank is similarly constructed and includes connecting panels 75 and 76 which are foldably joined to side wall 4 along arcuate fold lines 77 and 78. Also end panels 79 and 80 are foldably joined to connecting panels 75 and 76 remote from side wall 4 along arcuate fold lines 81 and 82 respectively.

In order to form the carrier as shown in FIG. 1 from the blank shown in FIG. 2, top panel 1 is disposed in contact with the tops of the articles to be packaged and, thereafter, side walls 2 and 4 are folded alongside the articles as is well known. Then the bottom panels 31 and 33 are folded along their respective fold lines 32 and 34 and tightened into an overlapping relationship with each other while simultaneously locking tabs 45, 46 and 47 are inserted into locking apertures 48, 49 and 50, respectively, as is well known.

Simultaneously with the formation of the carrier, end panels 71, 72, 79 and 80 and their respective connecting panels 67, 68, 75, and 76 are folded inwardly, respectively, along fold lines 69, 70, 77, and 78. End flap 51 is then folded downwardly along fold line 52 to occupy an overlaping relationship with the upper portions of end panels 71 and 79. Likewise end flap 53 is folded downwardly along fold line 54 to a position overlapping the upper portions of end panels 72 and 80. The formation of the carrier is then complete.

According to one aspect of this invention the connecting panels 67, 68, 75 and 76 are folded inwardly and form an acute angle with their associated side wall. In the completed carrier this acute angle together with the concave relationship of the coresponding arcuate fold lines causes a bowing of the respective end panels 71, 72, 79 and 80. This in turn causes a biasing force between each end panel and its connecting panel and the associated side wall. Of course the end panels remain tightly closed and the necessity for a mechanical locking feature for the carrier is eliminated.

According to another feature of this invention, the lower point of convergence of the arcuate fold lines, as indicated by the letter X, is disposed inwardly of the carrier with respect to point Y which represents the point of convergence between the associated end edge of sloping panel 21 and the corresponding end edge of bottom panel 33. This allows the lower portion of end panel 80 to fit snugly against the heels of the associated packaged articles. While the structure associated with end panel 80 is discussed in detail for convenience purposes, it is understood that the same structure is provided in connection with the remaining end panels 71, 72 and 79.

The embodiments of the invention in which an exclusive property or privilege is claimed are defined as follows:

1. An article carrier comprising a top wall, a pair of side walls secured respectively to the side edges of said top wall, a bottom wall secured to the edges of said pair of side walls remote from said top wall, a connecting panel foldably joined to an end edge of one of said walls along a first arcuate fold line, an end panel foldably joined to said connecting panel remote from said one wall along a second arcuate fold line, said first and second arcuate fold lines being configured in a concave relationship with respect to said connecting panel, and said connecting panel being disposed inwardly with respect to the associated end of the carrier and at an acute angle to said one wall so as to impart inward bowing to said end panel.

2. An article carrier according to claim 1 wherein an end flap is foldably joined to an end edge of said top wall and is disposed in an overlapping relationship with the outer surface of said end panel.

3. An article carrier according to claim 2 wherein the fold line between said end flap and said top wall is disposed inwardly with respect to the associated end of the carrier and said top flap is disposed at an acute angle to said top wall.

4. An article carrier according to claim 2 wherein each end edge of said end flap is connected to the associated one of said side walls by means of a web panel.

5. An article carrier according to claim 1 wherein one of said side walls is secured to said bottom wall by means of a sloping panel and wherein the lower point of convergence of said first and second arcuate fold lines is positioned inwardly of the carrier with respect to the associated point of convergence between the end edge of said bottom wall and the end edge of said sloping panel.

* * * * *